US010288343B2

(12) United States Patent
Ramm et al.

(10) Patent No.: US 10,288,343 B2
(45) Date of Patent: May 14, 2019

(54) EZ REFRIGERATOR DOORS HEIGHT ADJUSTMENT

(71) Applicant: WHIRLPOOL CORPORATION, Benton Harbor, MI (US)

(72) Inventors: Axel Julio Ramm, St. Joseph, MI (US); Neomar Giacomini, St. Joseph, MI (US); Alexandre M. Fleig, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/880,114

(22) Filed: Jan. 25, 2018

(65) Prior Publication Data

US 2018/0149409 A1 May 31, 2018

Related U.S. Application Data

(63) Continuation-in-part of application No. 14/974,642, filed on Dec. 18, 2015, now abandoned.

(51) Int. Cl.
*F25D 23/02* (2006.01)
*E06B 3/34* (2006.01)
(Continued)

(52) U.S. Cl.
CPC ..... *F25D 23/028* (2013.01); *E05D 7/0027* (2013.01); *E05D 7/081* (2013.01);
(Continued)

(58) Field of Classification Search
CPC ..... F25D 23/028; E06B 3/34; E05D 15/00; E05D 7/0027; E05D 7/081; E05F 1/061; E05Y 2600/12; E05Y 2900/31
(Continued)

(56) References Cited

U.S. PATENT DOCUMENTS 4,750,701 A * 6/1988 Folson ..... A47C 3/24 248/406.1
6,524,147 B1 * 2/2003 Hundertmark ..... B63H 25/22 114/150
(Continued)

OTHER PUBLICATIONS

Eichenberger Gewinde, "Speedy high-helix lead screws," catalogue, http://pdf.directindustry.com/pdf/eichenberger-gewinde/speedy-high-helix-lead-screws/13697-641024.html, Jan. 25, 2018, 6 pages.
(Continued)

*Primary Examiner* — Daniel J Troy
*Assistant Examiner* — Timothy M Ayres
(74) *Attorney, Agent, or Firm* — Price Heneveld LLP

(57) ABSTRACT

A refrigerator includes an insulated cabinet having an opening and a first hinge structure. The refrigerator includes a door including a second hinge structure that is movably connected to the first hinge structure. A height adjustment lever operably interconnects the first and second hinge structures. Movement of the lever in a first direction causes the door to move upwardly, and movement of the lever in a second direction causes the door to move downwardly. A stop limits movement of the height adjustment lever in at least one of the first and second directions. The lever is preferably movable by hand, such that tools are not required to adjust the door height/position.

20 Claims, 8 Drawing Sheets

(51) Int. Cl.

| | |
|---|---|
| ***E05D 15/00*** | (2006.01) |
| ***E05D 7/00*** | (2006.01) |
| ***E05D 7/081*** | (2006.01) |
| *E05F 1/06* | (2006.01) |

(52) U.S. Cl.
CPC ..... *E05D 15/00* (2013.01); *E06B 3/34* (2013.01); *E05F 1/061* (2013.01); *E05Y 2600/12* (2013.01); *E05Y 2900/31* (2013.01)

(58) Field of Classification Search
USPC ..... 312/405
See application file for complete search history.

(56) References Cited

U.S. PATENT DOCUMENTS

| | | | |
|---|---|---|---|
| 7,490,384 | B2 | 2/2009 | Lee |
| 8,166,612 | B2 | 5/2012 | Bertolini et al. |
| 8,388,077 | B2 | 3/2013 | Park |
| 8,444,238 | B2 | 5/2013 | Choi |
| 8,683,655 | B2 | 4/2014 | Hong |
| 9,074,809 | B2 | 7/2015 | Lee et al. |
| 2013/0147336 | A1 | 6/2013 | Lee et al. |
| 2013/0154464 | A1 | 6/2013 | Fiori et al. |
| 2014/0259529 | A1 | 9/2014 | Jenkinson |
| 2018/0283067 | A1* | 10/2018 | Wu ..... E05D 7/0027 |

OTHER PUBLICATIONS

ABSSAC CO. UK, "Precision Lead Screws," catalogue, https://www.abssac.co.uk/catalogue/v/precision-lead-screws/Precision+Lead+Screws/1/#/page/1, Jan. 25, 2018, 85 pages.

* cited by examiner

EZ REFRIGERATOR DOORS HEIGHT ADJUSTMENT

CROSS-REFERENCE TO RELATED APPLICATION

This application is a Continuation-in-Part of U.S. patent application Ser. No. 14/974,642 filed on Dec. 18, 2015, entitled "EZ REFRIGERATOR DOORS HEIGHT ADJUSTMENT," now abandoned, the entire disclosure of which is incorporated herein by reference.

BACKGROUND OF THE INVENTION

Known refrigerators typically include insulated cabinets and one or more doors that are mounted to the cabinet by hinges. Known refrigerators may include adjustment devices to permit vertical adjustment of the door relative to the cabinet. However, known door adjustment arrangements may suffer from various drawbacks.

SUMMARY OF THE INVENTION

A refrigerator includes an insulated cabinet having an opening that provides access to an interior compartment and a first hinge structure. The refrigerator also includes a door having a second hinge structure that is movably connected to the first hinge structure. The door is configured to close off at least a portion of the opening when the door is in a closed position relative to the insulated cabinet. A height adjustment lever operably interconnects the first and second hinge structures. Movement of the lever in a first direction causes the door to move upwardly relative to the insulated cabinet, and movement of the lever in a second direction that is opposite to the first direction causes the door to move downwardly relative to the cabinet. A stop limits movement of the height adjustment lever in at least one of the first and second directions.

Another aspect of the present disclosure is a height adjustable hinge assembly for connecting a refrigerator door to an insulated refrigerator cabinet. The height adjustable hinge assembly includes a first hinge structure, and a second hinge structure that is pivotably connected to the first hinge structure. A height adjustment lever operably interconnects the first and second hinge structures. Movement of the lever in a first direction causes the door to move upwardly relative to the insulated cabinet, and movement of the lever in a second direction that is opposite to the first direction causes the door to move downwardly relative to the cabinet. A stop limits movement of the height adjustment lever in at least one of the first and second directions.

These and other features, advantages, and objects of the present disclosure will be further understood and appreciated by those skilled in the art by reference to the following specification, claims, and appended drawings.

BRIEF DESCRIPTION OF THE DRAWINGS

FIG. 15;

FIG. 16.

DETAILED DESCRIPTION

Figure 1:
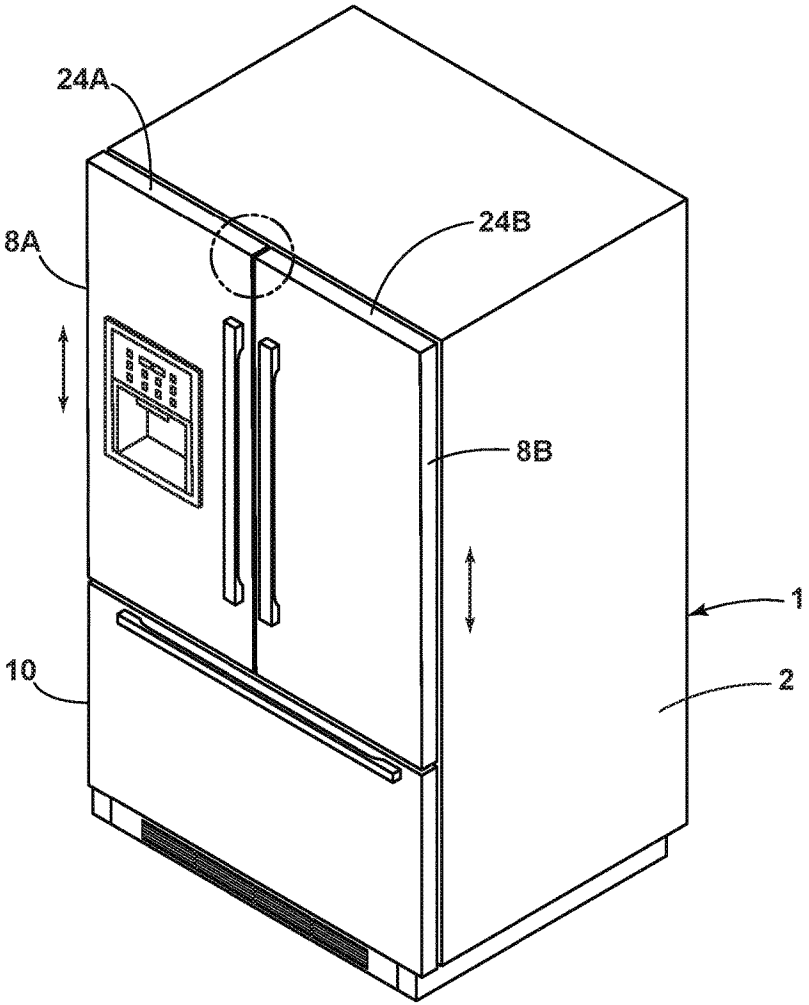
FIG. 1 is an isometric view of a refrigerator.

For purposes of description herein, the terms "upper," "lower," "right," "left," "rear," "front," "vertical," "horizontal," and derivatives thereof shall relate to the disclosure as oriented in FIG. 1. However, it is to be understood that the disclosure may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
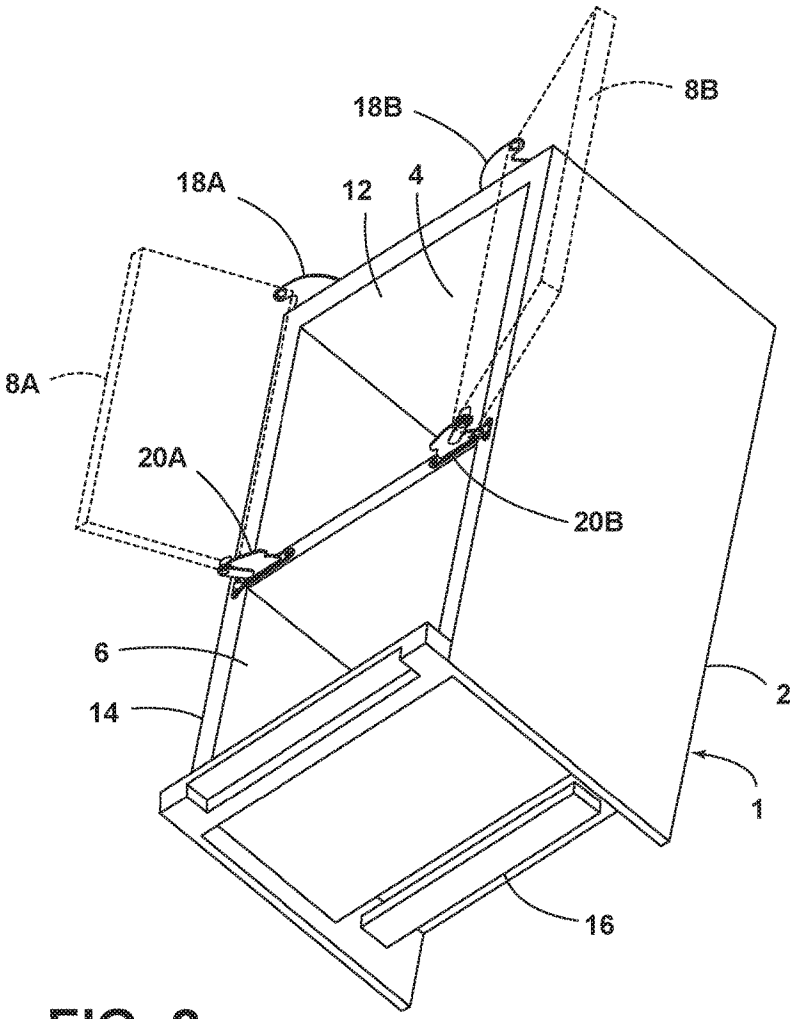
FIG. 2 is an isometric view of the refrigerator of FIG. 1.

With reference to FIGS. 1 and 2, a refrigerator 1 includes an insulated cabinet 2 having one or more openings 4 and 6 that may be closed off by doors 8A and 8B, and 10, respectively. In the illustrated example, doors 8A and 8B are french doors that close off a single opening 4 providing access to a fresh food compartment 12. The door 10 may comprise a movable door or drawer that provides access to a freezer compartment 14. The refrigerator 1 includes a powered cooling system 16 that cools the compartments 12 and 14. The cooling system 16 may comprise a known system of the type including a compressor, condenser, evaporator, and related components that are generally known in the art. Doors 8A and 8B are movably connected to the cabinet 2 by upper hinges 18A and 18B, and lower hinges 20A and 20B, respectively. Hinges 18A and 18B may comprise a known design that permits vertical movement of doors 8A and 8B relative to cabinet 2. As discussed in more detail below, hinges 20A and 20B include adjustment features that permit vertical movement/adjustment of the doors 8A and 8B relative to cabinet 2. This height adjustment ensures that the upper edges 24A and 24B of doors 8A and 8B, respectively, are at the same height (FIG. 1), thereby ensuring that the appearance of the refrigerator 1 is acceptable. Hinge 20B is discussed in more detail below. Hinges 20A and 20B are mirror images of each other, and the following description of hinge 20B also applies to hinge 20A, except that the corresponding components are mirror images of each other.

Figure 3:
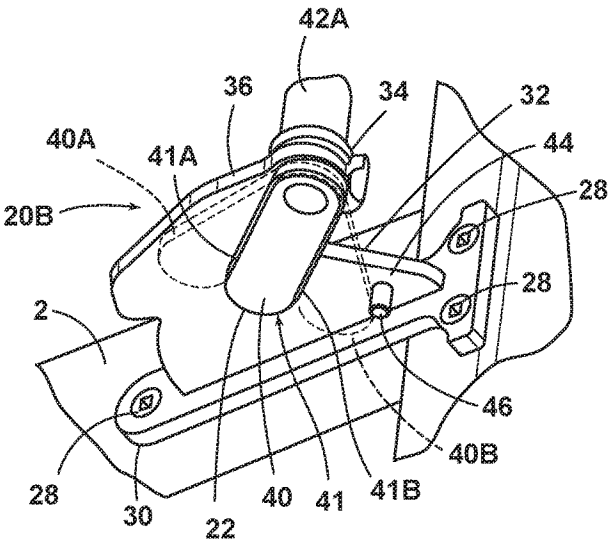
FIG. 3 is an isometric view of a hinge structure and height adjustment lever.
Figure 4:
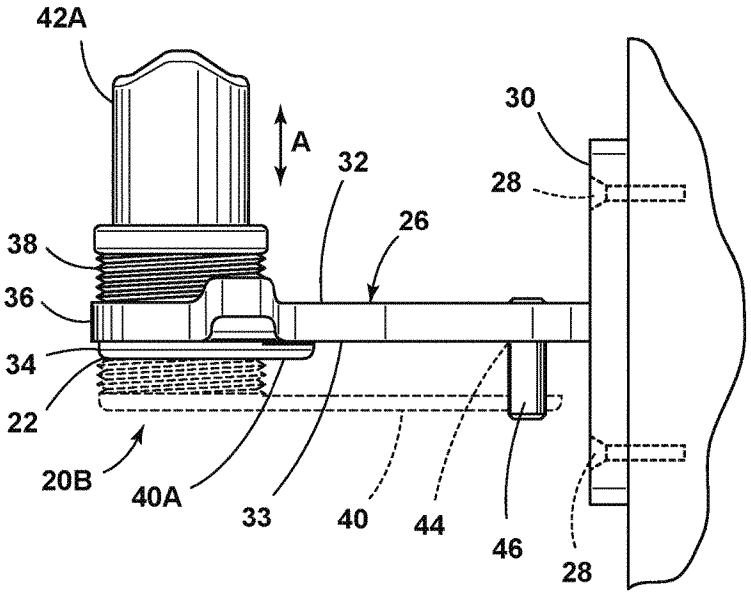
FIG. 4 is a side elevational view of a hinge structure and height adjustment lever of FIG. 3.
Figure 6:
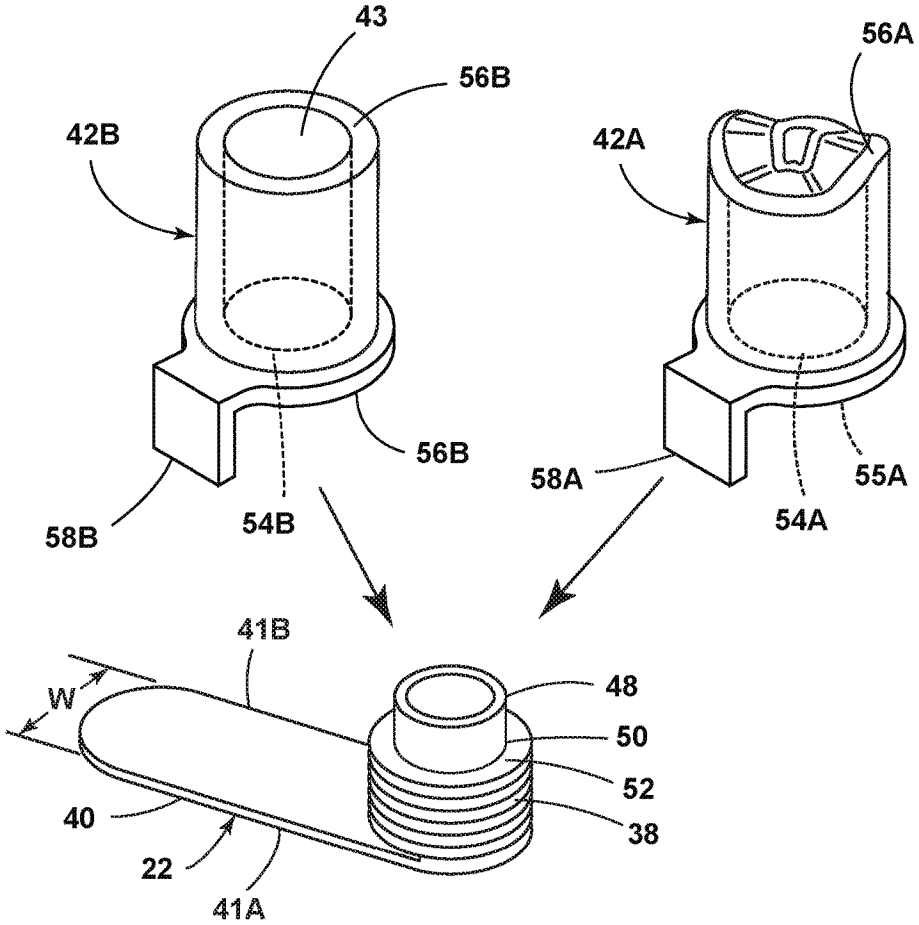
FIG. 6 is an exploded isometric view showing a height adjustment lever and two different types of hinge bushings.

With reference to FIGS. 3 and 4, hinge 20B includes a first hinge structure or bracket 26 that is secured to cabinet 2 by fasteners 28. Bracket 26 includes a base 30 and an outwardly-extending structure or protrusion 32. The base 30 and protrusion 32 may comprise plate-like structures having generally uniform thickness. A threaded opening 34 adjacent outer end 36 of protrusion 32 threadably receives a threaded portion 38 of adjustment lever 22. As discussed in more detail below, adjustment lever 22 includes an arm 40 with opposite side edges 41A and 41B defining a width "W" (FIG. 6). Arm 40 can be grasped and rotated by a user to vertically shift the adjustment lever 22 and door 8B as shown by the arrow "A" (FIG. 4). If right-handed threads are utilized, rotation of lever 22 in a clockwise direction (FIG. 3) causes lever 22 to shift upwardly, thereby raising door 8B, and rotation of lever 22 in a counterclockwise direction causes lever 22 to shift downwardly thereby lowering door 8B. As also discussed in more detail below, a hinge bushing 42A disposed on adjustment lever 22 engages door 8B and provides for rotation of door 8B relative to cabinet 2. A threaded opening 44 in protrusion 32 receives a set screw 46. Set screw 46 limits rotation of adjustment lever 22 in the counterclockwise direction to a maximum counterclockwise rotational position 40B (FIG. 3) due to contact between side edge 41B of lever 22 and set screw 46, thereby ensuring that the adjustment lever 22 is not inadvertently completely disconnected from threaded opening 34 of bracket 26 during adjustment of the height of the door 8B. When lever 22 is rotated clockwise to a maximum clockwise rotational position 40A (FIG. 3), lever 22 contacts lower surface 33 of bracket 26 and thereby prevents rotation of lever 33 beyond a rotational position 40A corresponding to a maximum upwardly-adjusted position of door 8B. Thus, set screw 46 provides a counterclockwise rotational stop at position 40B corresponding to a lowermost height adjustment of door 8B, and lower surface 33 of bracket 26 provides a clockwise rotational stop at position 40A corresponding to an uppermost height adjustment of door 8B.

Figure 5:
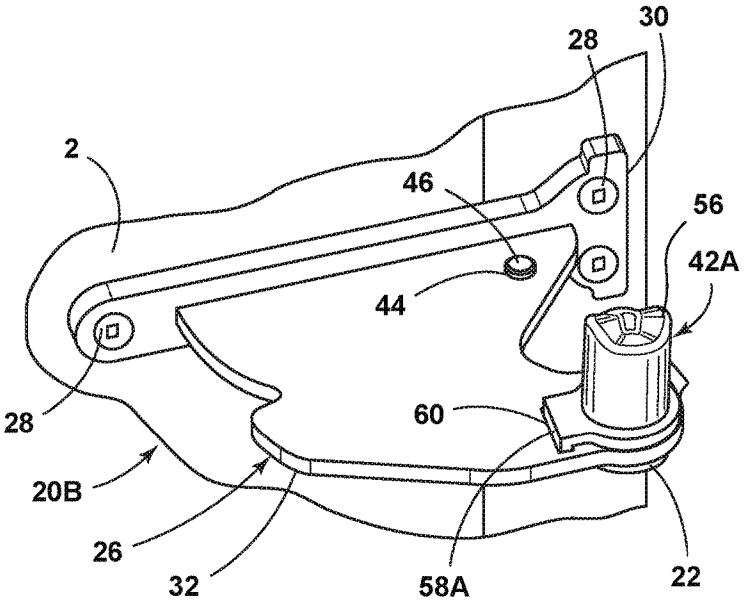
FIG. 5 is an isometric view of the hinge structure and height adjustment arm of FIG. 3 showing a hinge bushing.

With further reference to FIGS. 5 and 6, adjustment lever 22 includes an end portion 48 having a cylindrical outer surface 50. The end portion 48 preferably has an outer diameter that is somewhat less than the outer diameter of the threaded portion 38. An annular ring-shaped surface 52 extends transversely from the cylindrical surface 50 to the threaded portion 38. When assembled, the end portion 48 of adjustment lever 22 is received in an opening 54 of hinge bushing 42A, and annular surface 52 of adjustment lever 22 slidably engages end surface 55A or 55B of bushing 42A or bushing 42B, respectively. The bushing 42A comprises a gravity closer bushing having tapered upper surfaces 56A that are configured to generate a moment tending to close the door 8B. Alternatively, the end portion 48 of adjustment lever 22 may be received in an auto closer bushing 42B. As discussed below, auto closer bushing 42B includes a slot or opening 43 that is configured to receive and rotatably engage an auto-closer shaft 68 (FIG. 9) when door 8 is installed. The auto closer bushing 42B may be utilized in connection with a spring or other mechanism (not shown) that generates a force biasing the door 8B towards a closed position.

Bushings 42A and 42B include tabs 58A and 58B, respectively. When assembled, the tabs 58A or 58B are received in a slot 60 in protrusion 32 of bracket 26. The slot 60 is located adjacent to threaded opening 34. The engagement of tabs 58A and 58B with slot 60 prevent rotation of bushings 42A and 42B relative to bracket 26, while permitting vertical movement of bushings 42A and 42B relative to bracket 26.

Figure 9:
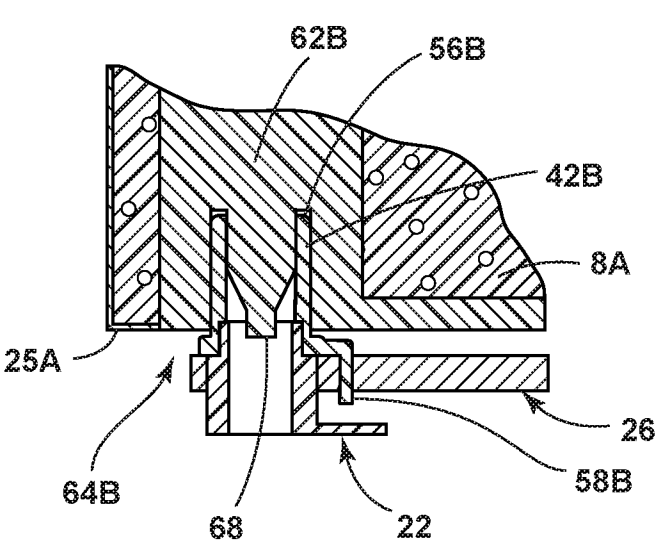
FIG. 9 is a partially fragmentary cross sectional view showing an auto closing bushing assembly.

With further reference to FIG. 9, the threaded portion 38 of adjustment lever 22 includes "buttress" threads 39 wherein the load-bearing thread face is perpendicular to the screw access "A1" or at a slight slant (typically no greater than 7°). The other face is slanted at about 45°. The threaded portion 38 is preferably self-locking such that increased refrigerator door loads do not cause the adjustment lever 22 to rotate. Although "buttress" threads are presently preferred, it will be understood that the present disclosure is not limited to this type of thread. Threads 39 are preferably right-handed, but could be left-handed. The threads utilized at hinge 20A (FIG. 2) may have left-handed threads if the threads of hinge 20B are right-handed, and vice-versa. This provides for mirror-image operation of the levers 22 utilized in hinges 20A and 20B. Alternatively, hinges 20A and 20B may both utilize right-handed threads, or hinges 20A and 20B may both utilize left-handed threads.

Figure 8:
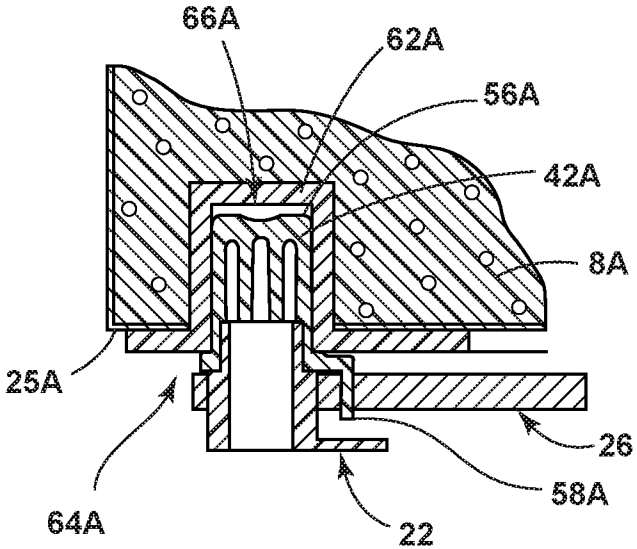
FIG. 8 is a partially fragmentary cross sectional view showing a gravity closing bushing assembly.

With further reference to FIG. 8, when assembled, gravity closer bushing 42A is received in a gravity closure outer bushing 62A. Outer bushing 62A is disposed in an opening 64A at lower edge 25A of door 8A. The outer bushing 62A includes an inner surface 66A that slidably engages end surface 56A of bushing 42A to generate a force tending to close door 8A when door 8A is opened. The shape and configuration of the surfaces 56A and 66A of bushings 42A and 62A, respectively, are generally known in the art, such that a detailed description of surfaces 56A and 66A is not believed to be required.

With further reference to FIG. 9, if an auto closer bushing 42B (FIG. 6) is utilized, an auto-closer member 62B is installed in lower edge 25A of door 8A. Auto-closer member 62B includes an opening or pocket 64B that rotatably receives an end portion 56B of bushing 42B, and a shaft 68 disposed in pocket 64B. When assembled, shaft 68 is received in slot/opening 43 of bushing 42B to thereby rotatably support the door 8A. The configuration of auto closer bushing 42B and auto-closer member 62B may be similar to known auto closer bushing arrangements, such that a detailed description of these features is not believed to be required.

Referring again to FIGS. 3-6, during assembly adjustment lever 22 is threadably connected to bracket 26 by rotating the adjustment lever 22 in a clockwise direction (if right handed threads are utilized) with threaded portion 38 in threaded engagement with threaded opening 34 of bracket 26. The adjustment lever 22 is initially rotated to an upper most position 40A wherein adjustment arm 40 is directly adjacent, or in contact with lower surface 33 of protrusion 32 of bracket 46 (FIG. 4). Position 40A of adjustment lever 22 corresponds to a maximum door height adjustment or position. Set screw 46 is then installed in threaded opening 44. Rotation of adjustment lever 22 in a counterclockwise direction causes the adjustment lever 22 to move downwardly until side edge 41B of arm 40 contacts set screw 46. The set screw 46 limits rotation of arm 40 of adjustment lever 22 to a position 40B, and ensures that the adjustment lever 22 cannot be rotated to a position in which the threaded portion 38 of adjustment lever 22 would disengage from threaded opening 34. In the illustrated example, rotation of adjustment lever 22 is thereby limited to a range of about 30°. However, the maximum rotation of lever 22 may be in the range of about 10°-45°, as may be required for a particular application. Rotation of lever 22 is preferably limited such that arm 40 does not project outwardly beyond the front face or side edge of door 8B, such that arm 40 remains positioned below lower edge 25A (FIGS. 8 and 9) of door 8B.

As discussed above, when adjustment lever 22 is rotated to a maximum rotational position 40A in the clockwise direction (corresponding to an uppermost door height adjustment position), arm 40 contacts lower surface 33 of bracket 26 (FIG. 4). Conversely, when adjustment lever 22 is rotated to a maximum counterclockwise rotational position 40B (corresponding to a lowermost door height adjustment position), side edge 41B of arm 40 of adjustment lever 22 contacts set screw 46, thereby limiting rotation of adjustment lever 22. After the adjustment lever 22 and set screw 46 are installed to bracket 26, a bushing 42A or 42B is then positioned on end portion 48 of adjustment lever 22, with tab 58A or 58B, respectively, in slot 60 of bracket 26. The door 8A may then be positioned on the hinges 18B and 20B.

If necessary, adjustment lever 22 can be rotated to adjust the height of the door 8A. As discussed above, hinge 20A is a mirror image of hinge 20B. Accordingly, hinge 20A and door 8A can be assembled in substantially the same manner as described above for the hinge 20B and door 8B.

Figure 7:
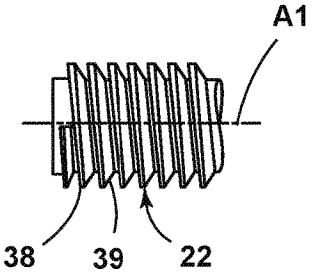
FIG. 7 is a partially fragmentary view showing the buttress-type threads of the height adjustment lever.

The pitch of the threads 39 (FIG. 7) of threaded portion 38 of adjustment lever 22 may be selected to provide a required range of adjustment for the height of the doors 8A and 8B. For example, the pitch of the threads may be selected to provide a total vertical adjustment range of about 6 mm when lever 22 is rotated through its maximum allowable rotational range (e.g. 30°). The components can be designed such that the doors 8A and 8B are nominally at the correct height when arm 40 of adjustment lever 22 is at a central rotational location that is midway or centered between the maximum rotational adjustment positions 40A and 40B. If the heights of the doors 8A and/or 8B need to be adjusted, rotation of adjustment lever 22 can be utilized to shift the door 8A or 8B up about 3 mm, or down about 3 mm from the center of the range of adjustment.

The adjustment lever 22 enables a user to rotate the adjustment lever 22 by hand, such that tools are not required. Also, because the adjustment lever 22 is relatively small, and positioned between the upper doors 8A and 8B, and lower door 10, the adjustment lever 22 is generally hidden below bracket 26. The stop provided by set screw 46 ensures that the adjustment lever 22 cannot be inadvertently disengaged from the bracket 26. The stop provided by lower surface 33 (FIG. 4) of bracket 26 ensures that arm 40 of lever 22 cannot be rotated outwardly to a position in which arm 40 would project outwardly beyond the front surfaces of the doors 8A or 8B. Also, as shown in FIG. 3, the arm 40 is preferably always completely below bracket 26, even when arm 40 is rotated to outermost position 40A. Accordingly, the present disclosure provides an intuitive solution for easy adjustment of refrigerator door height without requiring use of any specific tool.

Figure 10:
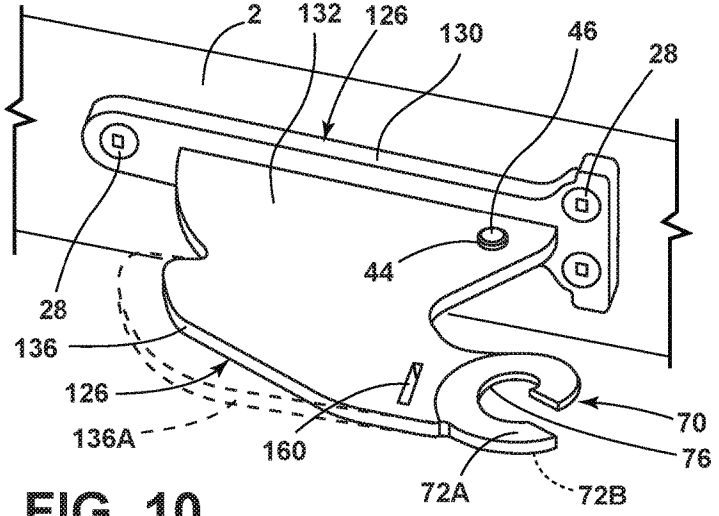
FIG. 10 is a partially fragmentary isometric view of a hinge structure according to another aspect of the present invention.
Figure 11:
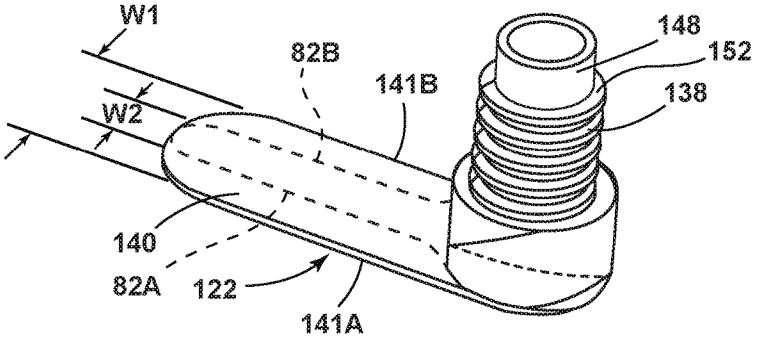
FIG. 11 is an isometric view of a height adjustment lever according to another aspect of the present invention.

With further reference to FIG. 10, a bracket 126 according to another aspect of the present invention is somewhat similar to bracket 26. However, bracket 126 includes a helical threaded portion 70 (rather than threaded opening 39 of bracket 26) that is configured to engage high-pitch threads 138 of an adjustment lever 122 (FIG. 11). Bracket 126 may be attached to an insulated cabinet 2 by threaded fasteners 28 or the like. An opening or slot 160 in bracket 126 corresponds to the slot 60 of bracket 26, and may receive a tab 58A (e.g. FIG. 5) of a hinge bushing 42A. Bracket 126 may include an outer edge 136 having substantially the same size and shape as edge 36 of bracket 26 (FIG. 3). Alternatively, bracket 126 may have an edge 136A that extends outwardly, further from base 130. Relative to the arrangement of FIG. 3, edge 136A permits a larger rotation of adjustment lever 122A before a portion of arm 140 protrudes outwardly beyond edge 136A of bracket 126. Helical portion 70 of bracket 126 includes a curved inner edge 73 and helical opposite surfaces 72A and 72B forming threads that are configured to engage threads 138 of an adjustment lever 122 (FIG. 11). It will be understood that helical portion 70 may have a configuration (shape) that is somewhat similar to a split lock washer as shown in FIG. 10. This permits helical portion 70 to be formed from the sheet metal of protrusion 132, which has a substantially uniform thickness. Alternatively, the helical portion 70 may comprise a closed sleeve (not shown) having a generally cylindrical inner surface having threads that are configured to engage threads 138 of adjustment lever 122.

Figure 12:
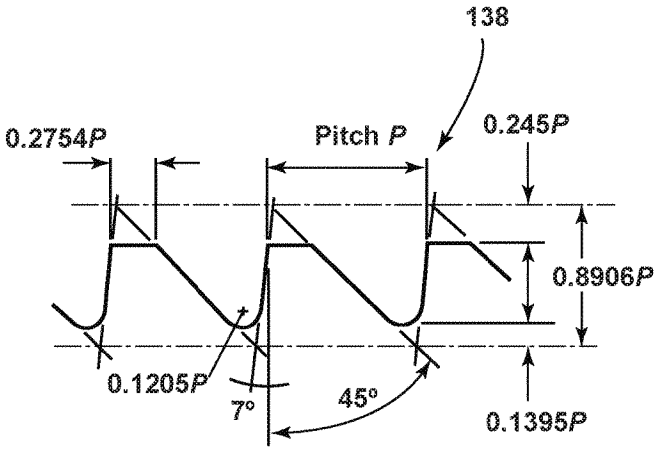
FIG. 12 is a schematic view showing the threads of the adjustment lever of FIG. 11.

Adjustment lever 122 may include opposite edges 141A and 141B defining a width "W1" that may be substantially equal to the width W (FIG. 6) of lever 22. Alternatively, adjustment lever 122 may have edges 82A and 82B defining a width "W2" that is significantly smaller than widths W and W1. Narrow width W2 provides a greater range of rotation (e.g. 30°-60°) of adjustment lever 122 before the edges 82A and 82B contact get screw 46 or protrude outwardly from below bracket 126 relative to the arrangement of FIG. 3. The adjustment lever 122 includes a cylindrical end portion 148 that may be substantially identical to the end portion 48 of adjustment lever 22 discussed in more detail above in connection with FIGS. 5 and 6. The cylindrical end portion 148 is configured to be received in an opening 54 of a hinge bushing 42A (see also FIG. 14), and annular ring-shaped surface 152 slidably engages an end surface 55A of a bushing 42A. The threads 138 may comprise buttress threads as shown schematically in FIG. 12. The threads 138 form a helix H having a lead L corresponding to a circumference of cylinder C and angles A and B.

Figure 14A:
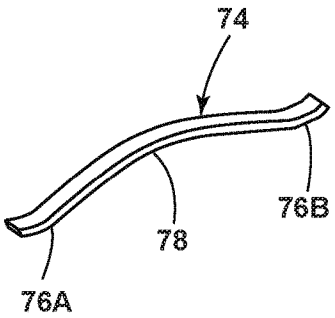
FIG. 14A is an isometric view of a spring.
Figure 13:
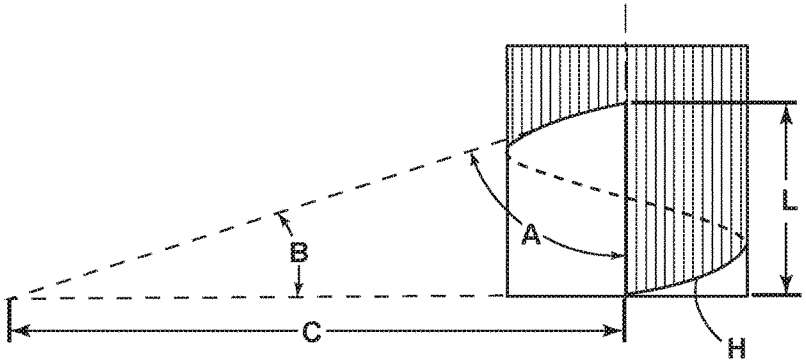
FIG. 13 is a schematic view showing the thread pitch of the adjustment lever of FIG. 11.
Figure 14:
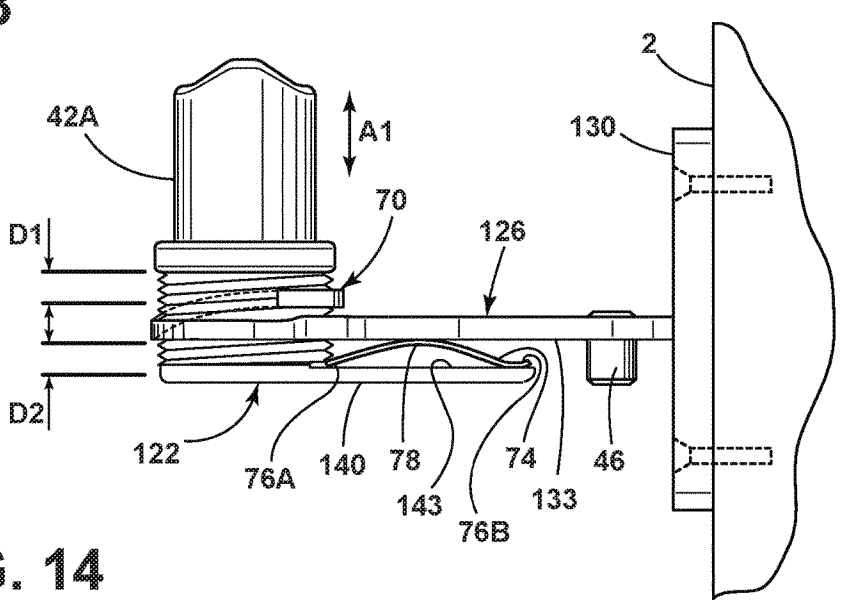
FIG. 14 is a partially fragmentary view of a hinge structure and height adjustment lever including a spring.

With further reference to FIGS. 14 and 14A, a leaf spring 74 may be disposed between arm 40 and bracket 126. The leaf spring 74 may be made from a resilient material (e.g. steel), and includes a central portion 78 and opposite end portions 76A and 76B. The central portion 78 of leaf spring 74 engages lower surface 133 of bracket 126, and the opposite ends 76A and 76B of leaf spring 74 engage upper surface 143 of arm 40, thereby generating an upward force acting on bracket 126, and downward forces acting on lever 140. Central portion 78 of spring 74 may be fixed to bracket 126 and ends 76A and 76B may slidably engage surface 143 of arm 140. Alternatively, central portion 78 may slidably engage bracket 126, and ends 76A and 76B may be fixed to arm 140. These forces create additional friction acting between threads 138 of lever 122 and helical portion 70 of bracket 126. Furthermore, the leaf spring 74 slidably/frictionally engages one or both surfaces 133 and 143 to create a frictional force tending to prevent rotation of adjustment lever 122. The stiffness of leaf spring 74 may be adjusted as required to provide the required degree of friction to thereby prevent automatic or inadvertent rotation of adjustment lever 122 after the adjustment lever 122 is moved to a desired position to adjust the vertical position of a refrigerator door (e.g. doors 8A and 8B of FIG. 2).

The bracket 126 and adjustment lever 122 may be configured to cause a relatively large vertical movement of the refrigerator door upon relatively small rotation of adjustment lever 122. For example, rotation of adjustment lever 122 may be limited to a range of about 30 degrees due to set screw 46 and contact between arm 140 and lower surface 133 of bracket 126. The helical portion 70 of bracket 126 and threads 138 may be configured to provide, for example, a vertical adjustment range of about 6 mm when lever 122 is rotated through the maximum allowable range (e.g. 30 degrees). In FIG. 14, the vertical dimensions D1 and D2 generally correspond to the upward and downward vertical adjustment distances. In the illustrated example, D1 and D2 may be 3 mm as discussed above.

Alternatively, if adjustment lever 122 has a reduced width "W2" (FIG. 11) and/or if bracket 126 includes a larger protrusion 132 (FIG. 10) with an edge 136A, adjustment lever 122 may cause maximum vertical adjustment (e.g. 6 mm) when lever 122 rotates through a somewhat larger angular range (e.g. 45°or 60°). The larger angular range of travel reduces the forces required to rotate adjustment lever 122. The pitch of threads 138 and helical portion 70 may be configured to provide vertical movement of 4-8 mm as required for a particular application. These vertical movements may be provided with rotation angles of lever 122 of, for example, 30°, 45°, or 60° (or angles between 30°-60°).

Figure 15:
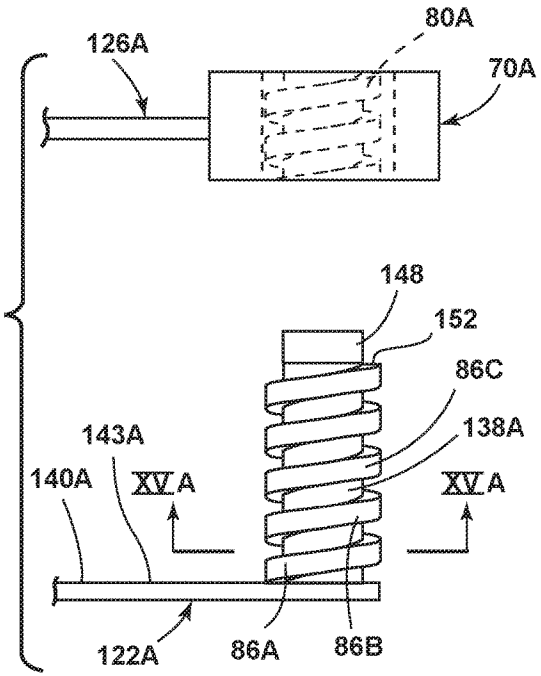
FIG. 15 is a partially fragmentary exploded view of a height adjustment lever and bracket according to another aspect of the present invention.
Figure 15A:
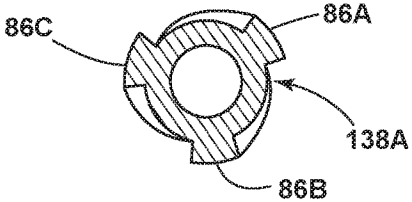
FIG. 15A is a cross sectional view taken along the line XVA-XVA.

With further reference to FIGS. 15 and 15A, an adjustment lever 122A according to another aspect of the present invention includes high pitch square threads 138A. The threads 138A are configured to engage square internal threads 80A of a bracket 126A. The threads 138A may include three or more threads 86A-86C to provide a very high pitch.

Figure 16:
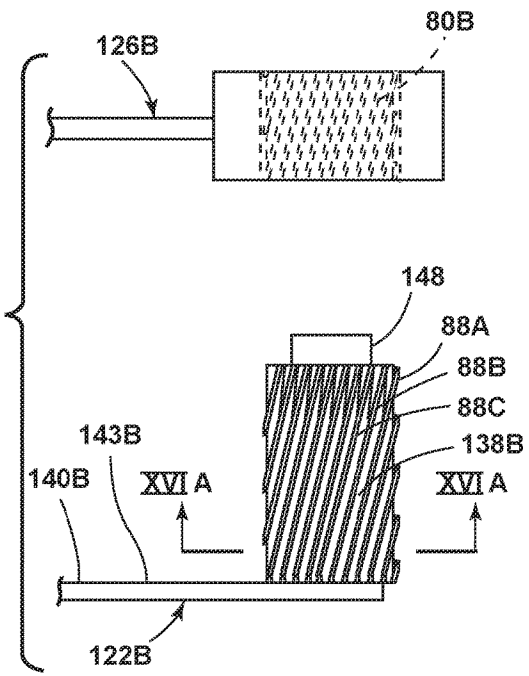
FIG. 16 is a partially fragmentary exploded view of a height adjustment lever and bracket according to another aspect of the present invention.
Figure 16A:
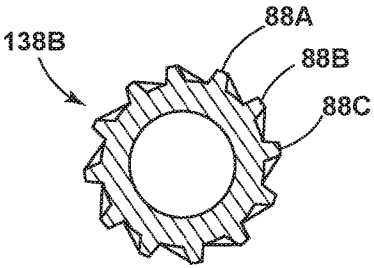
FIG. 16A is a cross sectional view taken along the line XVIA-XVIA.

With further reference to FIGS. 16 and 16A, an adjustment lever 122B according to another aspect of the present invention may include high helix teeth 88A, 88B, 88C, etc. that are configured to slidably engage corresponding internal teeth or threads 80B of a bracket 126B. The threads 138B and internal threads 80B may be configured to provide a high helix (pitch) as required to provide a desired vertical adjustment (e.g. 4, 6, 8 mm) upon rotation of lever 122B through a limited range (e.g. 30°, 45°, 60°).

A spring 74 (FIG. 14A) may be utilized with the lever arms and brackets of FIGS. 15, 15A, 16, and 16A if required to generate additional friction to prevent rotation of the lever arms 122A and 122B once a desired adjustment height has been achieved. Also, although the adjustment levers are generally configured to be rotated by hand, it will be understood that an extension (e.g. a section of tube or pipe) may be utilized to apply additional torque if required.

It is to be understood that variations and modifications can be made on the aforementioned structure without departing from the concepts of the present disclosure, and further it is to be understood that such concepts are intended to be covered by the following claims unless these claims by their language expressly state otherwise.

The invention claimed is:

1. A refrigerator comprising:

an insulated cabinet having an opening and a first hinge structure comprising a bracket having an outwardly-extending structure including a threaded opening;

a door having a vertical front face and including a second hinge structure that is pivotably interconnected to the first hinge structure, wherein the door is configured to close off at least a portion of the opening when the door is in a closed position relative to the insulated cabinet;

a height adjustment lever including a lever arm positioned below the outwardly-extending structure and a threaded portion extending upwardly from the lever arm and engaging the threaded opening, the height adjustment lever operably interconnecting the first and second hinge structures whereby rotation of the lever in a first direction causes the door to move upwardly relative to the insulated cabinet, and rotation of the lever in a second direction that is opposite the first direction causes the door to move downwardly relative to the cabinet, wherein the lever arm would project outwardly beyond the front face of the door if the lever arm were to be rotated to an orientation in which the lever arm extends away from the insulated cabinet;

a one-way first stop that limits rotation of the height adjustment lever in the first direction without restricting rotation of the height adjustment lever in the second direction; and a one-way second stop that limits rotation of the height adjustment lever in the second direction without restricting rotation of the height adjustment lever in the first direction such that a maximum rotation of the height adjustment lever between the first and second stops is in a range of about 10°-45° to thereby permit rotation of the height adjustment lever when the lever arm is positioned below the door while preventing rotation of the lever arm to a position in which the lever arm would project beyond the front face of the door.

2. The refrigerator of claim 1, wherein:

the height adjustment lever includes an end portion having a cylindrical outer surface above the threaded portion; and including:

a bushing rotatably disposed on the end portion of the height adjustment lever.

3. The refrigerator of claim 2, wherein:

the bushing slidably engages the first hinge structure whereby the bushing moves vertically relative to the first hinge structure, but does not rotate relative to the first hinge structure.

4. The refrigerator of claim 3, wherein:

the outwardly-extending structure of the bracket comprises an arm that protrudes outwardly from the cabinet adjacent the opening.

5. The refrigerator of claim 4, wherein:

the arm includes a guide opening adjacent to the threaded opening;

the bushing includes an extension that is slidably received in the guide opening to limit rotation of the bushing relative to the arm while permitting vertical movement of the bushing relative to the arm.

6. The refrigerator of claim 5, wherein:

the first stop comprises an upwardly-extending protrusion on the arm that limits rotation of the height adjustment lever relative to the arm.

7. The refrigerator of claim 6, wherein:

the arm includes a threaded stop opening;

the stop comprises a threaded member that threadably engages the threaded stop opening.

8. The refrigerator of claim 7, wherein:

the lever arm contacts the threaded member when the height adjustment lever is in a minimum height position, and wherein the lever arm contacts the second stop when the height adjustment lever is in a maximum height position, and wherein rotation of the height adjustment lever from the minimum height position to the maximum height position causes the door to move upwardly at least about 6 mm relative to the insulated cabinet.

9. The refrigerator of claim 1, including;

an upper hinge positioned directly above the first and second hinge structures and pivotably connecting the door to the insulated cabinet.

10. A height adjustable hinge assembly for connecting a refrigerator door having a vertical front face to an insulated refrigerator cabinet, the height adjustable hinge assembly comprising;

a first hinge structure;

a second hinge structure pivotably connected to the first hinge structure;

a height adjustment lever operably interconnecting the first and second hinge structures whereby rotation of the lever in a first direction causes the door to move upwardly relative to the insulated cabinet, and rotation of the lever in a second direction that is opposite the first direction causes the door to move downwardly relative to the cabinet; and one-way first and second stops that only limit rotation of the height adjustment lever in the first and second directions, respectively, while permitting free rotation between the first and second stops through a maximum allowable range, and wherein rotation through the maximum allowable range causes the door to move about 6 mm, and wherein the height adjustment lever cannot be rotated to a position in which the height adjustment lever would project beyond a front face of a refrigerator door.

11. The height adjustable hinge assembly of claim 10, wherein:

the first hinge structure includes first threads;

the height adjustment lever includes second threads rotatably engaging the first threads whereby rotation of the height adjustment lever relative to the first hinge structure causes the lever to shift vertically.

12. The height adjustable hinge assembly of claim 11, wherein:

the second hinge structure comprises an opening;

the height adjustment lever includes a threaded portion that is received in the opening.

13. The height adjustable hinge assembly of claim 12, wherein:

the threaded portion comprises an upwardly-extending portion of the height adjustment lever.

14. The height adjustable hinge assembly of claim 13, including:

a bushing disposed on the upwardly-extending portion of the height adjustment lever.

15. The height adjustable hinge assembly of claim 14, wherein:

the bushing slidably engages the first hinge structure whereby the bushing moves vertically relative to the first hinge structure, but does not rotate relative to the first hinge structure.

16. A refrigerator comprising:

an insulated cabinet having an opening and a first hinge structure comprising a bracket having an outwardly-extending structure including a threaded opening;

a door having a vertical front face and including a second hinge structure that is pivotably interconnected to the first hinge structure, wherein the door is configured to close off at least a portion of the opening when the door is in a closed position relative to the insulated cabinet;

a height adjustment lever including a lever arm positioned below the outwardly-extending structure and a threaded portion extending upwardly from the lever arm and engaging the threaded opening, the height adjustment lever operably interconnecting the first and second hinge structures whereby rotation of the lever in a first direction causes the door to move upwardly relative to the insulated cabinet, and rotation of the lever in a second direction that is opposite the first direction causes the door to move downwardly relative to the cabinet, wherein the lever arm would project outwardly beyond the front face of the door if the lever arm were to be rotated to an orientation in which the lever arm extends away from the insulated cabinet;

a one-way first stop that limits rotation of the height adjustment lever in the first direction without restricting rotation of the height adjustment lever in the second direction; and a one-way second stop that limits rotation of the height adjustment lever in the second direction without restricting rotation of the height adjustment lever in the first direction such that a maximum rotation of the height adjustment lever between the first and second stops is in a range of about 30°-60° to thereby permit rotation of the height adjustment lever when the lever arm is positioned below the door while preventing rotation of the lever arm to a position in which the lever arm would project beyond the front face of the door.

17. The refrigerator of claim 16, wherein:

the outwardly-extending structure of the bracket comprises a bracket arm that protrudes outwardly from the cabinet adjacent the opening.

18. The refrigerator of claim 17, wherein:

the bracket arm includes a guide opening adjacent to the threaded opening;

the bushing includes an extension that is slidably received in the guide opening to limit rotation of the bushing relative to the bracket arm while permitting vertical movement of the bushing relative to the bracket arm.

19. The refrigerator of claim 1, wherein:

the bracket arm includes a threaded stop opening;

the first stop comprises a threaded member that threadably engages the threaded stop opening.

20. The refrigerator of claim 19, wherein:

the lever arm contacts the threaded member when the height adjustment lever is in a minimum height position, and wherein the lever arm contacts the second stop when the height adjustment lever is in a maximum height position, and wherein rotation of the height adjustment lever from the minimum height position to the maximum height position causes the door to move upwardly at least about 4 mm relative to the insulated cabinet.

* * * * *